US006008167A

United States Patent [19]

Appelman et al.

[11] Patent Number: 6,008,167

[45] Date of Patent: Dec. 28, 1999

[54] LUBRICANT

[75] Inventors: Eric Appelman, Dordrecht; Dirk Kenbeek, Oudewater; Hendrik Leendert Rieffe, Gouda, all of Netherlands

[73] Assignee: Unilever Patent Holdings B.V., Vlaardingen, Netherlands

[21] Appl. No.: 08/836,575

[22] PCT Filed: Nov. 9, 1995

[86] PCT No.: PCT/EP95/04418

§ 371 Date: Jul. 16, 1997

§ 102(e) Date: Jul. 16, 1997

[87] PCT Pub. No.: WO96/15210

PCT Pub. Date: May 23, 1996

[30] Foreign Application Priority Data

Nov. 14, 1994 [EP] European Pat. Off. ..... 942033002

[51] Int. Cl.[6] ..... C10M 129/70

[52] U.S. Cl. ..... 508/463; 554/1

[58] Field of Search ..... 554/1; 508/463

[56] References Cited

U.S. PATENT DOCUMENTS 2,757,139 7/1956 Matuszak .
2,796,441 6/1957 Mertzweiller .
4,591,452 5/1986 Worschech et al. ..... 252/400
5,322,633 6/1994 Senaratne et al. .

FOREIGN PATENT DOCUMENTS 1 101 881 5/1981 Canada .
706 205 3/1954 United Kingdom .
706205 3/1954 United Kingdom .
775 017 5/1957 WIPO .
92/10462 6/1992 WIPO .

OTHER PUBLICATIONS

Patent Abstracts of Japan, vol. 01, No. 0172, (C–354), Jun. 18, 1986 & JP,A,61 024542, Feb. 3, 1986, see abstract.

*Primary Examiner*—Cephia D. Toomer
*Attorney, Agent, or Firm*—Pillsbury Madison & Sutro Intellectual Property Group

[57] ABSTRACT

An ester based lubricant, particularly suitable for 4-stroke engines comprises at least one ester of a saturated, branched chain monohydric alcohol having at least 8 carbon atoms and a saturated branched chain aliphatic monocarboxylic acid having at least 10 carbon atoms. The esters have a kinematic viscosity of at most 35 cSt (40° C.), a non-polarity index of at least 100, a Noack evaporation loss of at most 10% and a pour point below −30° C.

8 Claims, No Drawings

LUBRICANT

This application is the national phase of international application PCT/EP95/04418, filed Nov. 9, 1995 which was designated the U.S.

The present invention relates to ester based lubricants for four-stroke engines, which comprise at least one ester containing one ester bond.

Friction is the force which resists the relative motion of two contacting bodies and in practice several distinct friction regimes are distinguished. If sliding surfaces are in direct contact there is dry or solid friction, but if the sliding surfaces are separated by a solid, fluid or gaseous medium, then there is lubricated or fluid friction. In the regime of the transition from lubricated to dry friction one has mixed friction in which regime both former types of friction occur simultaneously. The mixed friction in the regime of transition to dry friction is called boundary friction. The total picture is therefore: dry friction—boundary friction—mixed friction—fluid friction. The function of a lubricant is to reduce the friction between two contacting and moving bodies as much as possible and thus to prevent wear. The lubricant will also remove the heat of friction and the wear particles from the load-carrying zone and it will seal off the lubricated area so that nothing can enter this zone which might disrupt the lubrication action.

The relation between viscosity (x), bearing load (p), sliding velocity (v) and friction coefficient ($\mu$) has been depicted by R. Stribeck (1902) in a curve which since then is called the Stribeck curve. This curve is obtained by plotting the friction coefficient $\mu$ along the ordinate and the product $$\frac{xv}{p}$$

along the absciss.

In the first (left hand) part of this graph the curve falls rather steeply and has the form of half a parabola, but at a certain moment it shows a point of inflection, after which the curve is gradually but slowly climbing again. The point of inflection in the Stribeck curve occurs at the so-called transition speed where mixed friction passes into fluid friction. The working range of the lubricant is then defined by the lower and upper working limits both situated in the right hand part of the Stribeck curve where fluid friction is fully developed. The lower working limit is situated as close as possible to the point of inflection. The Stribeck curve shows that the properties of the lubricant (particularly its viscosity) are to be selected such that the best compromise is reached between friction losses in the region of hydrodynamic lubrication (fully developed film) and bearing wear in the region of mixed friction. Thus the lower working limit is selected preferably as close as possible to the point of inflection of the transition speed, but the closer one is to this point, the greater will be the influence of the additives on the lubricant, in other words: the selection of the additives will be very critical at the lower working limit. From the Stribeck curve it can be concluded that for a given situation of bearing load and sliding velocity, the performance of the lubricant will to a large extent be dictated by its viscosity.

The viscosity of ester based lubricants is not only dependent on their molecular weight, but also and particularly on their molecular structure and the presence of unreacted hydroxyl groups. The requirements for a good viscosity are often conflicting, however, with the molecular and structural requirements for good flow properties (viscosity index (V.I.) and pour point), good lubricity (polarity) and thermal and oxidative stability. Thus improvement of certain properties is not seldom achieved at the cost of other properties.

It has now been found in extensive experiments that excellent ester based lubricants having a set of good properties may be obtained by a careful selection of their chemical and molecular structure. These esters have only one ester bond and hence constitute simple esters, contrary to the complex esters which are often used in ester based lubricants. It is surprising that such relatively simple molecules exhibit various good properties at the same time and this the more so since no polyhydric alcohols and/or polybasic acids are used in their manufacture, thus restricting the amount of possibilities in achieving certain desired chemical structures and physical properties.

Since the esters have only one ester bond, their polarity due to the lone pair on the oxygen atom of the ester linkage is relatively low in comparison to the polyhydric alcohol based esters and the complex esters. Polar molecules are very effective boundary lubricants, however, since they tend to form physical bonds with the metal surface. It is therefore surprising that the presence of only one ester bond can still provide sufficient lubricity. At the same time the efficiency of antiwear additives is still high. A problem with very polar base fluids is that these preferentially cover the metal surface instead of the antiwear additives and consequently there is higher wear. Stated differently: there is competition between the ester lubricant and the antiwear additives. The ester based lubricants according to the present invention, which are particularly suitable for use in four-stroke engines, enable an efficient use of the various additives with optimum effect and at the same time have sufficiently low viscosity for a good fuel economy of the lubricated engine, whilst yet retaining good flow properties and lubricity and a low volatility (important for longer oil-change intervals).

Therefore the present invention relates to an ester based lubricant for four-stroke engines comprising at least one ester of a saturated, branched chain aliphatic monohydric alcohol having at least 8 carbon atoms and a saturated, branched chain aliphatic monocarboxylic acid having at least 10 carbon atoms, said ester having:

(a) a kinematic viscosity at 40° C. of at most 35 cSt, (b) a non-polarity index (NPI)

$$NPI = \frac{\text{total number of carbon atoms} \times \text{molecular weight}}{\text{number of carboxylate groups} \times 100}$$

(c) an evaporation loss according to Noack (determined according to European Standard CEC L-40-T-82) of at most 10%, and (d) a pour point below −30° C.

The ester based lubricants according to the present invention may be based on one single ester, but also mixtures of esters may be used. The use of mixtures of esters according to the present invention may sometimes lead to positive synergism in required properties, for example the pour point may be improved. The use of ester mixtures is therefore preferred. Also the esters according to the present invention may be mixed with other simple esters.

The saturated, branched chain aliphatic monohydric alcohols are preferably selected from the group consisting of Guerbet alcohols, oxo alcohols, aldol condensation derived alcohols, and mixtures thereof. Also branched chain alcohols obtained in paraffin oxidation or from other sources, such as hydration of olefins or the Reppe process, may be used. Suitable alcohols have been described in Ullmann's Encyclopedia of Industrial Chemistry, 5th edition, 1985, volume A1, page 279–303 "Aliphatic alcohols", VCH Verlagsgesellschaft mbH, Weinheim BRD. Examples of alcohols derived from aldol condensation are 2-ethylhexanol-1, isohexadecyl alcohol and iso-octadecyl alcohol. Suitable oxo alcohols are iso-octanol (usually a mixture of about 80% dimethylhexanols, 15% methylheptanols and 5% mixed alcohols), iso-nonanol (about 80% dimethylheptanols and 20% trimethylhexanols), iso-decanol (usually originating from the hydroformylation of tri-propylene), isotridecylalcohol, and the like. Also 2 heptylundecanol, iso-C20 alcohol (such as Isofol-20, ex Condea) octanol-2, and the Guerbet alcohols, such as 2-butyl-octanol-1, 2-nonyl-tridecanol-1, and the like, may be used.

The saturated, branched chain aliphatic monocarboxylic acid having at least 10 carbon atoms may be branched in any position and sometimes branching occurs at several positions in the carbon chain. The branched chain acids may be produced by alkali fusion of alcohols, by oxidation of aldehydes or Guerbet alcohols, by carboxylation of olefins (Koch-Haag synthesis; Reppe process) or by paraffin oxidation, or any other suitable method. A description of branched chain fatty acids has been given in Ullmann's, Encyclopedia of Industrial Chemistry, 5th edition, 1985 in Volume A5, page 235–243 and Volume A10, page 245–276, respectively (VCH Verlagsgesellschaft mbH, Weinheim, BRD). Also the acids obtained by reaction of alpha-olefins with fatty acids may be used. Examples of suitable acids are iso-stearic acid, iso-palmitic acid, iso-decanoic acid (consisting of about 90% of trimethylhexanoic acid), Neo Acids (Trade Mark, ex Exxon/Enjay, Baton Rouge, La., USA), CeKanoic acids (Trade Mark, ex Ugine Kuhlmann, France), and the like acids.

The esters may be prepared by direct esterification or by interesterification.

In U.S. Pat. No. 2,757,139 (Esso) there have been described lubricant esters with general formula $RCOOR^1$ in which R and $R^1$ are selected from the group consisting of alkyl groups having 8–18 carbon atoms in a straight chain configuration and alkyl groups of a branched chain configuration containing 12–28 carbon atoms and which contain a major side chain of 4–14 carbon atoms. It has explicitly been stated, however, that R and $R^1$ may not be both branched or both linear.

In U.S. Pat. No. 2,862,013 (Monsanto Chemical Comp.) the ester di(tridecyl)tridecanoate has been described, having the following properties: viscosity index 64; viscosity 107.6 centigram seconds at 37.8° C.; pour point −31.7° C.; fire point 301.7° C. and flash point 204.4° C. The viscosity of this ester is far too high.

In European Patent Application EP-A-0,288,620 (Kao Corp.) there have been disclosed textile fiber lubricants, viz. the ester of 8-heptadecanoic acid and 8-hydroxymethyl heptadecane (compound B) and the ester of 9-hydroxymethyl nonadecane and a methyl-substituted 1-octadecanoic acid (compound E). Nothing has been indicated or suggested, however, as to the suitability of these esters for four-stroke engine lubrication.

Esters of branched chain fatty acids and branched chain fatty alcohols have also been proposed as lubricants for magnetic recording tapes in various patents such as United States Patent Specification U.S. Pat. No. 5,091,270 (Fuji Photo Film co. Ltd). The requirements for these lubricants are totally different from those for four-stroke engine lubricants, however. Important is here to provide excellent running durability over a wide range of temperatures and various humidity conditions.

Water dispersable cold rolling oil compositions for aluminium and aluminium-containing alloys comprising as a lubricant $C_8$–$C_{22}$ branched chain fatty alcohol esters of branched chain $C_8$–$C_{22}$ fatty acids have been disclosed in United States Patent Specification U.S. Pat. No. 4,800,034 (Kao corp.) but this use is entirely different from the lubrication of four-stroke engines and moreover no real working examples of these esters have been given.

Likewise in British patent Specification GB-A-1,023,379 (Esso Research & Eng. Corp.) lubrication greases comprising esters of hindered monohydric alcohols, such as 2, 2, 4, trimethyl-1-pentanol or 2,2-dimethyl-1-octanol and $C_4$–$C_{20}$ branched chain monocarboxylic acids have been proposed, but again there is no indication as to their suitability as lubricants for four-stroke engines and no real working examples have been given.

The kinematic viscosity of the ester lubricant according to the present invention is at most 35 centistokes (cSt), and preferably at most 30 cSt (at 40° C.). However, the kinematic viscosity should preferably not be too low, and should preferably be above 10 cSt. The viscosity can be influenced by the molecular weight of the ester and the size and/or degree of the chain branching of the alcohol or the acid. The viscosity index (V.I.) of the ester lubricant should preferably not be too low when the ester is used as lubricant in four-stroke engines. The V.I. may be controlled through the chain length of the acid and the alcohol and the degree of their branching. When both the alcohol as well as the acid component have a high degree of branching, the V.I. becomes too low for the lubricant to be used in e.g. four-stroke engines. Since the use of the oxo-process in the preparation of alcohols gives highly branched alcohols, it is preferred that the oxo-process is not used in the preparation of both the alcohol and the acid component which are used in the same ester. (The acid component may be prepared by oxidation of an alcohol.)

The ester lubricant according to the present invention has a non-polarity index (NPI;G. van der Waal, J.Synthetic Lubr. 1(4), 281 (1985)).

$$NPI = \frac{\text{total number of carbon atoms} \times \text{molecular weight}}{\text{number of carboxylate groups} \times 100}$$

of at least 100, preferably at least 125. The higher the NPI, the lower the affinity of the lubricant for the metal surface. Although the nonpolarity formula is only an approximation, since it takes no account of the chemical structure of the lubricant such as the degree of branching, it has in general been proven to be a good indicator, for the suitability of the esters according to the present invention.

The ester lubricant according to the present invention has a certain volatility which is measured as an evaporation loss as determined by the NOACK test, in which the weight loss at 250° C. is determined according to European Standard CEC-L-40-T-82. For the ester lubricant according to the invention the evaporation loss or volatility is at most 10% preferably at most 8%. Due to the branching in the acid part of the ester molecule, the hydrolytic stability of the lubricant ester according to the invention is also very good. Furthermore, the branched chain structure causes the lubricant ester to diffuse only very slowly into elastomers, thus imparting almost neutrality to elastomeric gasket material.

The pour point of the ester lubricant according to the present invention is below −30° C., preferably below −35° C. The high degree of branching has been found to have a very positive effect on the pour point.

The ester based lubricants according to the present invention can be formulated into complete lubricants by the use of various additives, of which some may have several functions (multipurpose additives), thus the esters may be combined with effective amounts of antioxidants (such as phenolic antioxidants like methylene-4,4[1]-bis (2,6-di-tert-butylphenol)), metal deactivators (such as metal dialkyldithiophosphates, which also act as corrosion inhibitor and extreme-pressure additive), viscosity index improvers (like polymethacrylates), pour point depressants, detergents, dispersants or heavy-duty additives (like alkylarylsulphonates), extreme pressure additives, friction modifiers, anti foam agents, corrosion inhibitors, and mixtures of these functional additives. The amounts applied vary considerably, but in general from 0.01 to 10% by weight based on the ester lubricant can be used.

The invention will now further be illustrated on hand of the following examples. In a preferred embodiment, the acid number of the esters of the present invention are reduce by reaction with a glycidyl ester of branched monocarboxylic acids.

EXAMPLE I

A four liter five-necked reaction vessel, equipped with a mechanical stirrer, a thermometer, a Dean-Stark trap with a vertically arranged water cooler and an inlet for inert gas was charged with 1426 grams (4.88 moles) iso-stearic acid (PRIOSORINE 3501, Trade Mark, ex Unichema Chemie B.V., the Netherlands), 1070 grams (5.37 moles) iso-tridecanol and 750 mg stannous oxalate as catalyst.

The reaction mixture was heated to 230° C. for 5 hours under a constant nitrogen flow. The condensed reaction water was collected in the Dean-Stark trap and the iso-tridecanol was refluxed continuously.

The reaction was proceeded by vacuum distillation at 230° C. and 20 mbar to remove the excess of iso-tridecanol. The crude reaction product was a clear light yellow liquid with a acid value of 0.1. The kinematic viscosity at 40° C. was 19.8 cSt, the non-polarity index was 144, the Noack evaporation loss was 8.0% and the pour point was −31° C.

EXAMPLE II

A four liter five-necked reaction vessel, equipped with a mechanical stirrer, a thermometer, a water cooler and an inlet for inert gas was charged with 1188 grams (4.03 moles) iso-stearic acid (PRIOSORINE 3501, Trade Mark, ex Unichema Chemie B.V., the Netherlands) and 1312 grams (4.90 moles) 2-octyldecanol/2-hexyldodecanol mixture (Isofol 18E, Trade Mark, ex Condea chemie GmbH, Germany).

The reaction mixture was heated to 230° C. for 5 hours under a constant nitrogen flow. The condensed reaction water was distilled off.

After the acid value had fallen to below 10, 250 mg tetrabutyltitanate as catalyst was added to the reaction mixture. After the acid value had fallen below a value of 1, 14 grams of Cardura E-10 (Trade Mark, a glycidyl ester of a synthetic saturated monocarboxylic acid mixture of highly branched C10-isomers ex Shell Resins, the Netherlands) was added to the reaction mixture. The mixture was heated for one hour at 230° C. and proceeded by vacuum distillation to remove the excess of Isofol 18E and Cardura E-10 at 270° C. and 12 mbar. The crude reaction product was a clear yellow liquid with an acid value of 0.1. The kinematic viscosity at 40° C. was 22.3 cSt, the non-polarity index was 193, the Noack evaporation loss was 3.9% and the pour point was −52° C.

EXAMPLE III

A four liter five-necked reaction vessel, equipped with a mechanical stirrer, a thermometer, and a water cooler and an inlet for inert gas was charged with 1304 grams (4.42 moles) iso-stearic acid (PRIOSORINE 3501, Trade Mark, ex Unichema Chemie B.V., the Netherlands) and 1196 grams (4.01 moles) 2-octyldodecanol (Isofol 20, Trade Mark, ex Condea Chemie GmbH, Germany).

The reaction mixture was heated to 230° C. for 5 hours under a constant nitrogen flow. The condensed reaction water was distilled off.

After the acid value had fallen to below 15, the excess of iso-stearic acid was removed by vacuum distillation at 270° C. and 12 mbar. After the acid value had fallen below a value of 3, 45 grams Cardure E-10 (Trade Mark, a glycidyl ester of a synthetic saturated monocarboxylic acid mixture of highly branched $C_{10}$-isomers, ex Shell Resins, the Netherlands) was added to the reaction mixture. The mixture was heated for one hour at 230° C. and proceeded by vacuum distillation to remove the excess of Cardure E-10 at 230° C. and 12 mbar. The crude reaction product was a clear yellow liquid with an acid value of 0.1. The kinematic viscosity at 40° C. was 26.2 cSt, the non-polarity index was 214, the Noack evaporation loss was 3.0% and the pour point was −35° C.

The esters as prepared in Examples I–III were excellent lubricants for four-stroke engines. By blending the ester obtained in Example III with 2-ethylhexyl isostearate (having a kinematic viscosity at 40° C. of 10.9 cSt, a non polarity index of 103, a Noack-evaporation loss of 16% and a pour point of −36° C.) four-stroke engine lubricants were obtained, having the same excellent properties as the esters prepared in examples I and II.

Thus, a mixture of 17% by weight of 2-ethylhexyl isostearate and 83% by weight of the product of example III led to a kinematic viscosity at 40° C. of 22.3 cSt, whereas a mixture of 29% by weight of 2-ethylhexyl isostearate and 71% by weight of the product of example III exhibited a kinematic viscosity at 40° C. of 19.8 cSt.

We claim:

1. An ester based lubricant comprising at least one ester of an alcohol selected from the group consisting of isotridecanol, 2-octyl decanol, 2-octyl dodecanol, 2-hexyl dodecanol, and mixtures thereof, and a saturated, branched chain aliphatic, monocarboxylic acid having at least 10 carbon atoms, said ester having:

(a) a kinematic viscosity at 40° C. of at most 35 cSt, (b) a non-polarity index (NPI)

$$NPI = \frac{\text{total number of carbon atoms} \times \text{molecular weight}}{\text{number of carboxylate groups} \times 100}$$

of at least 100

(c) an evaporation loss according to Noack (determined according to European Standard CEC L-40-T-82) of at most 10%, and (d) a pour point below −30° C., wherein the acid number of the ester is reduced by reaction with a glycidyl ester of branched chain monocarboxylic acids.

2. An ester based lubricant according to claim 1, said ester having a kinematic viscosity at 40° C. of at most 30 cSt.

3. An ester based lubricant according to 1, said ester having an evaporation loss of at most 8%.

4. An ester based lubricant according to claim 1, said ester having a pour point below −35° C.

5. An ester based lubricant according to claim 1, in which the saturated, branched chain aliphatic monocarboxylic acid is selected from the group consisting of iso-palmitic acid, iso-stearic acid, iso-decanoic acid, and mixtures thereof.

6. An ester based lubricant according to claim 1, which further comprises an effective amount of a functional additive selected from the group consisting of antioxidants, metal deactivators, corrosion inhibitors, extreme pressure additives, viscosity index improvers, pour point depressants, detergents, dispersants, friction modifiers, anti-foam agents, and mixtures thereof.

7. An ester based lubricant according to claim 6, comprising from 0.01 to 10% by weight of the total lubricant of the functional additive.

8. An ester based lubricant according to claim 1 further comprising 2-ethylhexyl isostearate.

* * * * *